United States Patent [19]

Kamijo

[11] 4,223,523

[45] Sep. 23, 1980

[54] ELECTRONIC ANALOG ALARM TIMEPIECE

[75] Inventor: Noriyuki Kamijo, Suwa, Japan

[73] Assignee: Kabushiki Kaisha Suwa Seikosha, Tokyo, Japan

[21] Appl. No.: 5,534

[22] Filed: Jan. 22, 1979

[30] Foreign Application Priority Data

Jan. 20, 1978 [JP] Japan ..... 53/5370

[51] Int. Cl.[3] ..... G04C 3/00; G04C 21/00; G04B 23/00; G04B 37/12

[52] U.S. Cl. ..... 368/74; 368/72; 368/259

[58] Field of Search ..... 58/23 R, 85.5, 16 R, 58/38 R, 57.5, 50 R, 127 R, 152 R

[56] References Cited

U.S. PATENT DOCUMENTS

| | | | |
|---|---|---|---|
| 3,901,022 | 8/1975 | Cleusix et al. | 58/23 R |
| 4,092,820 | 6/1978 | Kume et al. | 58/23 R |
| 4,150,536 | 4/1979 | Nakajima et al. | 58/23 D |

*Primary Examiner*—J. V. Truhe
*Assistant Examiner*—John B. Conklin
*Attorney, Agent, or Firm*—Blum, Kaplan, Friedman, Silberman & Beran

[57] ABSTRACT

An electronic analog wristwatch includes an alarm which is set by rapidly, electromechanically driving the watch hands forward proximate to the desired alarm time, slowly advancing the hands electromechanically to the exact alarm setting, and then rapidly returning, by electromechanically driving, the hands to the actual present time. A counter records the number of drive pulses required to advance the hands to the alarm setting, while another counter records the time elapsed, measured in pulses, in setting the alarm including advancement and return of the hands. The number of pulses required for hand advancement is stored in memory. The pulses required for hand return are counted until the sum of the hand returning pulses and the elapsed time pulses equals the number of pulses which were required for advancing the hands, as stored in memory. At this time the watch is switched into its normal timekeeping mode, and the number of pulses required for return of the hands from the alarm setting to the actual time is stored in memory. The alarm is activated when a coincidence detector indicates that the number of real time pulses after return of the hands equals the count stored in memory.

25 Claims, 7 Drawing Figures

ELECTRONIC ANALOG ALARM TIMEPIECE

BACKGROUND OF THE INVENTION

This invention relates generally to an electronic wristwatch and more particularly to an analog electronic wristwatch with hands on the face to indicate the time and including an electronic alarm which is set and actuated by electronic means.

Many alarm mechanisms used to set the alarm time in analog alarm timepieces have been devised in the prior art. For example, Japanese Utility Model Publication No. 13978/68 discloses an alarm mechanism. However, even in the alarm timepieces of the prior art having an improved alarm mechanism, the alarm setting accuracy was only about plus or minus one minute. With the advent of electronic quartz crystal timepieces, the timekeeping accuracy of wristwatches has been greatly improved, however, the alarm mechanisms have not been comparably improved. Thus the alarm mechanism when combined with the electronic quartz crystal timekeeping capability is still not satisfactory. Briefly stated, the alarm setting accuracy is inferior to the timekeeping accuracy of the quartz crystal timepiece. Accordingly, no analog quartz crystal timepiece with an electronic alarm mechanism has existed up to this time.

What is needed is an electronic analog alarm wristwatch which provides accurate electronic setting of the alarm time, and uses the features of analog display, that is, the hands of the watch, in setting the alarm.

SUMMARY OF THE INVENTION

Generally speaking, in accordance with the invention, an electronic analog wristwatch providing means for accurately setting the alarm time is provided. The electronic analog wristwatch of this invention includes an alarm which is accurately set by rapidly, electromechanically driving the watch hands forward proximate to the desired alarm time, slowly advancing the hands electromechanically to the exact alarm setting, and then rapidly returning, by electromechanically driving, the hands to the actual present time. A counter records the number of drive pulses required to advance the hands to the alarm setting, while another counter records the time elapsed, measured in pulses, in setting the alarm including advancement and return of the hands. The number of pulses required for hand advancement is stored in memory. The pulses required for hand return are counted until the sum of the hand returning pulses and the elapsed time pulses equals the number of pulses which were required for advancing the hands, as stored in memory. At this time, the watch is switched into its normal timekeeping mode and the number of pulses required for return of the hands from the alarm setting to the actual time is stored in memory. The alarm is actuated when a coincidence detector indicates that the number of real time pulses after return of the hands equals the count stored in memory. The alarm is set with an accuracy of a few seconds.

Accordingly it is an object of this invention to provide an electronic analog alarm wristwatch which has an alarm which may be accurately set.

Another object of this invention is to provide an electronic analog alarm wristwatch which has its alarm electromechanically set by the internal watch circuits when actuated by an external member.

Still another object of this invention is to provide an electronic analog alarm wristwatch which automatically and accurately returns to the real present time after the alarm setting has been completed.

Yet another object of this invention is to provide an electronic analog alarm wristwatch which uses the electronic circuits to perform multiple functions of conventional electronic timekeeping and electronic alarm setting.

Another object of this invention is to provide an electronic analog alarm wristwatch which is thin and lightweight and aesthetically pleasing in appearance.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taking in connection with the accompanying drawings, in which.

DESCRIPTION OF THE PREFERRED EMBODIMENTS

This invention relates to an electronic timepiece that displays the time with hands on the watch face in the conventional manner. This type of wristwatch is called an electronic analog timepiece. This invention is more particularly concerned with an electronic analog alarm timepiece as discussed hereinafter.

Figure 1:
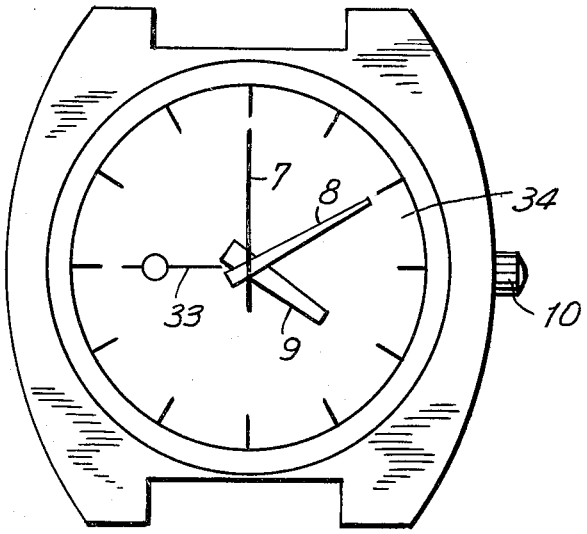
FIG. 1 PRIOR ART
FIG. 1 is a plan view of a conventional analog alarm timepiece of the prior art.
Figure 3:
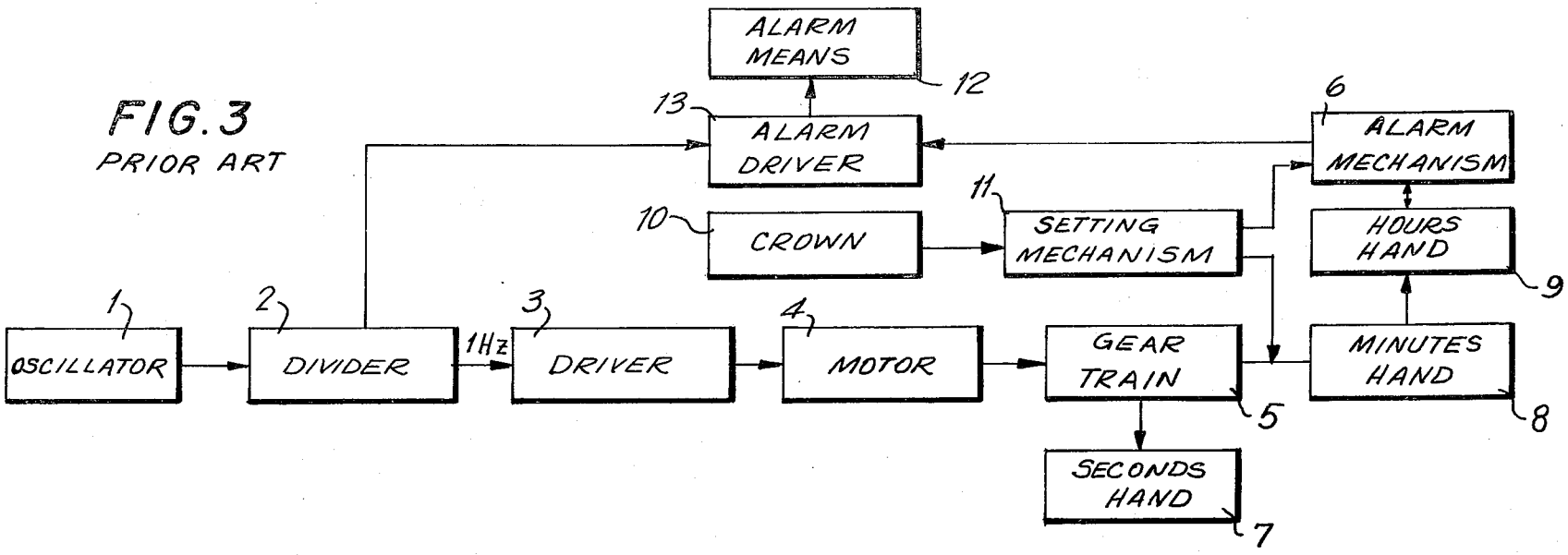
FIG. 3 PRIOR ART
FIG. 3 is a functional block diagram of the timepiece of FIG. 1.

FIGS. 1 and 3 show conventional electronic timepiece structures, well known in the prior art. Accordingly the details of description are abridged herein. In the prior art the high frequency oscillator 1 provides an output signal which is divided down in the divider circuits 2 to provide an output signal having a repetition frequency of 1 Hz. The divided signal is inputted to the driver 3 which advances the motor 4 which in turn drives the gear train 5. The hands of the timepiece, that is, the second hand 7, the minute hand 8, and the hour hand 9, are geared to the motor in a known manner to provide rotation of those hands at proportionate rates. The external crown 10 connects to an internal setting mechanism 11 used to move the minute hand 8 and set the alarm mechanism 6 to the desired time for operation of the alarm. The alarm driver 13 actuates the alarm, for example, a buzzer, upon receiving a signal from the alarm mechanism 6.

In use, to set the alarm the user first operates the crown 10. Thereby a well known alarm setting mechanism is actuated and the alarm mechanism 6 is also actuated. By turning the crown 10, the user sets an alarm hand 33 (FIG. 1) to the desired alarm time. When the time has elapsed and the alarm is due for sounding, a projection on the hour wheel driving the hour hand in the known manner coincides with a hole provided in an unlocking wheel for engagement with the projection. Then, a well known switch on the alarm driving circuit is operated by actuation of the hour wheel. An alarm driving signal of appropriate frequency is applied to the alarm means 12 through the alarm driving circuit 13, and then the alarm means 12 is actuated. However, in such a well known alarm mechanism of the prior art, the errors in attachment of the alarm hand and other variations in the structure cause the alarm to be one to several minutes early or late in relation to the preset alarm time. This is described in Japanese Utility Model Publication No. 13978/68.

In addition, because the conventional analog alarm timepiece of the prior art includes the alarm hand 33, the design of such a timepiece is limited in comparison with other popular timepieces. Also, the complicated alarm mechanism 6 used for actuating the alarm hand 33 causes the timepiece to be large in size and thick. The cost is also increased. Conventional analog alarm timepieces have many of the above-mentioned faults.

The electronic analog alarm timepiece of this invention substantially reduces or eliminates those faults. A detailed description of an embodiment in accordance with this invention is presented herein with reference to FIGS. 2 and 4 through 7.

Figure 2:
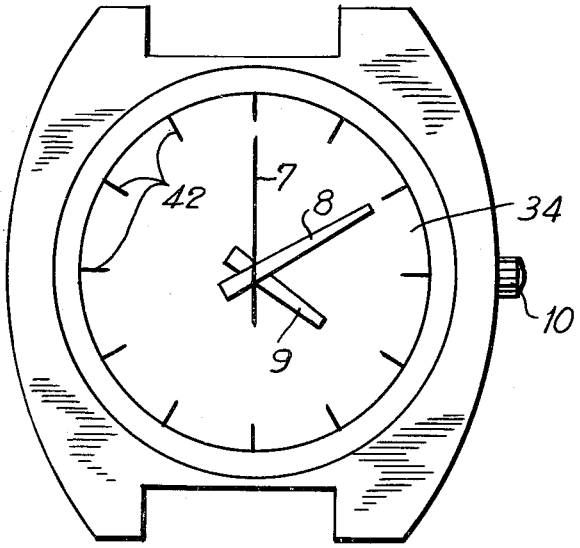
FIG. 2 is a plan view of an electronic alarm timepiece of this invention.
Figure 4:
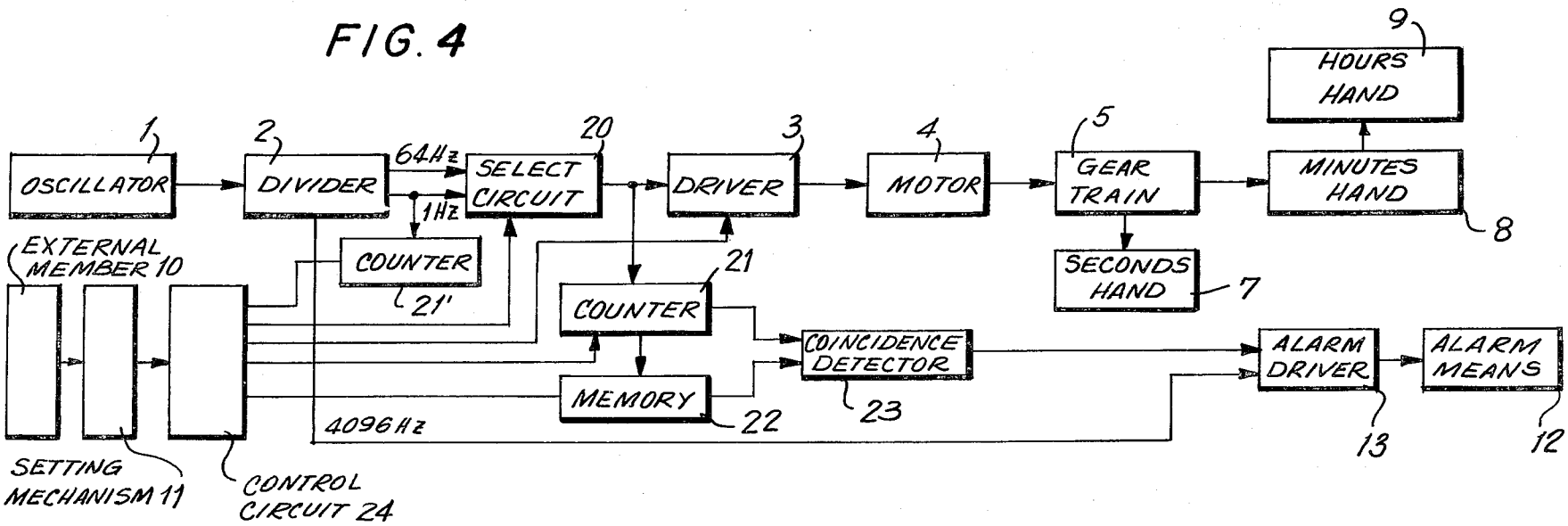
FIG. 4 is a functional block diagram of the timepiece of FIG. 2.

With reference to FIG. 4, the oscillator circuit 1 produces a high frequency output signal which is inputted to the divider network 2. The oscillation frequency of the oscillator 1 and the number of stages in the divider network 2 are selected such that at least two outputs are available from the divider 2, namely, a 1 Hz signal and a 64 Hz signal. The dual outputs of the divider 2 are inputted into a selecting circuit 20 which outputs either the 1 Hz or the 64 Hz signal to the driver 3 which controls operation of the motor 4. The motor 4, when actuated, drives the gear train 5 which in the known manner causes motion of the second hand 7, the minute hand 8 and the hour hand 9. An external member 10, such as a crown, button, or the like, is provided on the external side of the casing 37 thereby enabling the user to initiate the alarm setting cycle as described hereinafter. Internally, the external member 10 actuates the setting mechanism 11 which in turn acts upon the control circuit 24. The control circuit 24 outputs signals to the select circuit 20 which is intermediate the divider 2, and driver 3, to a pair of counters 21,21', and to a memory unit 22. An alarm 12, e.g., a buzzer, is driven by the alarm driver 13 at a frequency of 4096 Hz taken from an intermediate stage of the divider network 2. Initiation of an alarm signal is controlled by the output of the coincidence detector 23 which compares the contents of the counter 21 with the stored contents of the memory 22. The dial 34 of the timepiece is of conventional design as seen in FIG. 2 and includes any known markings of time as are generally used in analog type wristwatches. The illustration of FIG. 2 indicates only the position of the hours with short marking lines 42.

As shown in FIG. 2, the present time for the wristwatch, which for the purpose of this description is presumed to be operating, is 10 minutes and 0 seconds past the hour of 4 o'clock. This time is indicated with the hour hand 9, the minute hand 8 and the second hand 7 in conjunction with the dial 34. Thus, if the dial 34 were marked with conventional numerals, the numeral 3 would be proximate the external member 10 and the numeral 12 would be at the top of FIG. 2. Hereinafter this present time of precisely 10 minutes past 4 o'clock is referred to as the first present time. The hands 7,8,9 normally indicate the present time or what might also be called real or actual time, and are moved by driving pulses at the rate of 1 Hz from the divider circuit 2 through the well known structure comprising the oscillator circuit 1, divider circuit 2, driving circuit 3, motor 4 and gear train 5. The second hand 7 normally rotates at the rate of one movement per second and travels 6° around the dial with each motion.

In using the timepiece of this invention, in the situation where the user wants to set the alarm time to 5 o'clock, the setting mechanism 11 is actuated by operating the external member 10, e.g., the crown, and thereby the control circuit 24 is actuated. Following is a description of the steps whereby the timepiece is set to actuate the alarm at the desired 5 o'clock and then the timepiece is returned to actual time to continue normal operation until an actual time of 5 o'clock is reached when the alarm is in fact actuated.

The actuated control circuit 24 outputs a signal which is applied to the select circuit 20. At this signal, the select circuit 20 selects the 64 Hz output from the divider 2 and applies this 64 Hz signal to the driving circuit 3. The signal is in the form of pulses. In normal timekeeping, the select circuit 20 channels the 1 Hz output from the divider 2 to the driver 3.

The 64 Hz driving pulses from the divider 2 are amplified in the driving circuit 3 and transmitted to the motor 4. The motor actuates for each pulse inputted and drives the gear train 5 which quickly moves the hands on the dial 34. The second hand 7 moves quickly through 64 second positions or spacings on the dial in just one actual second. The minute hand 8 and hour hand 9 move in proportion as controlled by the gears in the gear train 5, all of conventional design. The user allows the hands to move until the hands indicate a time on the dial 34 which is just before the desired 5 o'clock setting for the alarm. The rapid motion of the hands is then suspended by operation of the external member 10. For example, if the external member is a button switch which has been depressed for rapid advance of the hands, the rapid advance is terminated when the button switch is released. At the instant that the operation of the external member 10 is suspended, the control circuit 24 switches the select circuit 20 so that the 1 Hz signal again provides driving pulses to the driving circuit 3. As a result, the second hand 7 now advances a single second distance or spacing on the dial 34 for each 1 Hz pulse in the same manner as in normal operation. In due time, the hands indicate exactly 5 o'clock which is the desired alarm time setting. At this moment, the user again operates the external member 10. Thereby, through the operation of the control circuit 24, the hands are made to stop moving at the positions in which the hands indicate exactly 5 o'clock, the alarm setting. It should be noted that although the hands stop moving, the oscillator 1 continues its high frequency output which is continuously divided down in the divider 2. Thus, the user has set the alarm time to 5 o'clock on the dial.

Figure 5:
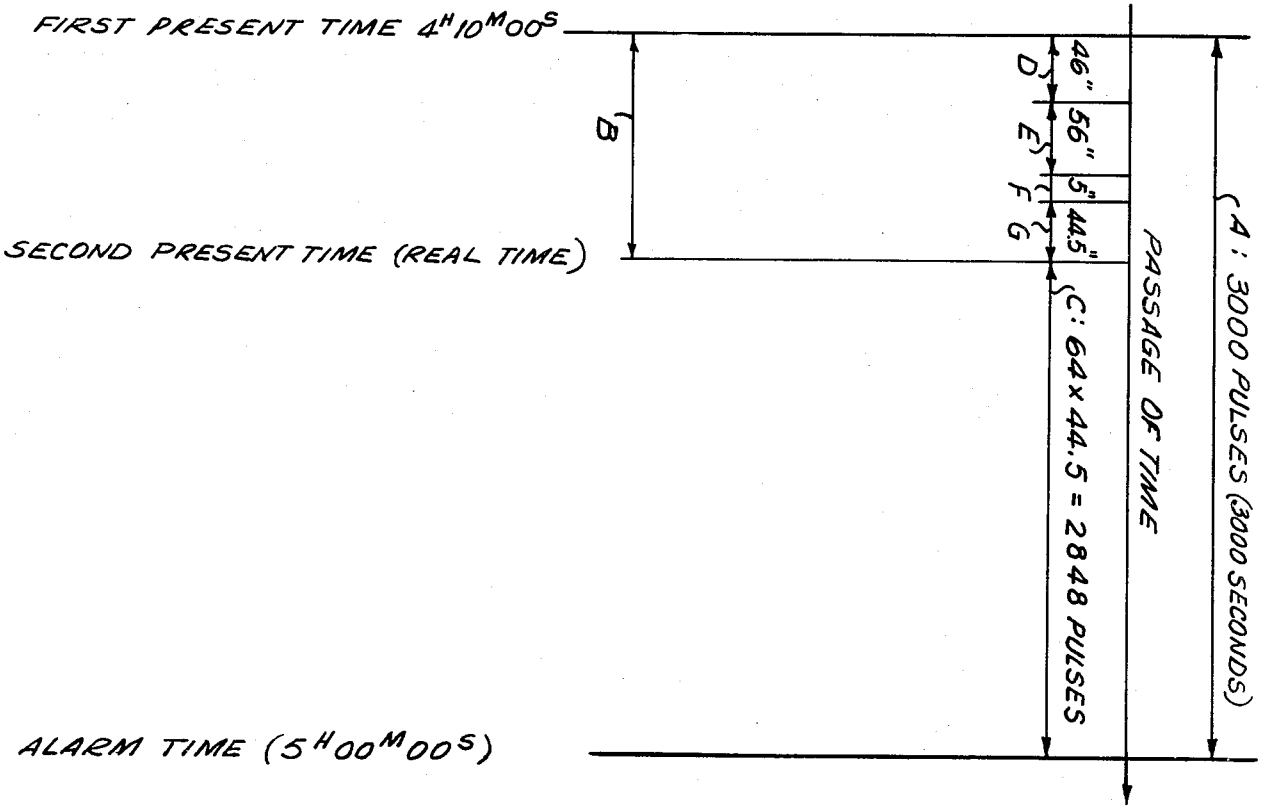
FIG. 5 is a timing chart showing the method of setting the alarm in accordance with this invention.

The method for setting the alarm time, and the method for returning the hands to the true real or actual time, is explained in more detail with reference to FIG. 5. There are 3,000 seconds between the first present time, namely 10 minutes past 4 o'clock, and the desired alarm time of 5 o'clock. Therefore, as stated above, the user in the first operation of the external member 10 causes the hands which are indicating the present time (4:10), to move quickly by means of a quick advance using driving pulses of 64 Hz. If, for the sake of an example, the quick advance is performed for 46 seconds, then 2944, that is, 46 seconds × 64 Hz equals 2944, driving pulses are applied to the driving circuit 3 via the select circuit 20 and the divider 2 during the 46 seconds. The hands are moved by the action of the gearing 5 to indicate 59 minutes and 4 seconds past 4 o'clock. At this time, as described above, the user ceases to operate the external member 10, and the timepiece automatically returns to a normal operating state in which the second hand advances a seconds spacing, i.e. 6 angular degrees, around the dial 34 for each normal pulse of 1 Hz. After continuing in this normal operating state for 56 seconds, the hands indicate exactly 5 o'clock. The number of driver input pulses, whether 1 Hz or 64 Hz, required from the condition in which the hands indicated the first present time (4:10) until the hands indicate the alarm time of 5 o'clock, is counted by the counter 21. In the present example, this is 3,000 pulses which are indicated in FIG. 5 by the difference designated A. Namely, the counter 21 counts that 3,000 driving pulses occur between the first present time and the moment when the hands have been set to the alarm time of 5 o'clock. It should be noted that the actual elapsed time for these 3,000 pulses includes 46 seconds of rapid advance designated in FIG. 5 as D, and 56 seconds of normal advance designated in FIG. 5 as E. The counter data, namely 3,000, is stored in the memory circuit 22 and at the same instant the counter 21 is reset to zero.

At the moment of the first actuation of the external member 10 to initiate the accelerated advance of the hands, the control circuit 24 starts the counter 21' which continuously counts the driving pulses of 1 Hz which are delivered from the divider network 2. In other words, the time required in seconds to set the hands to the alarm position is recorded, as a number of pulses, in the counter 21'. At this point in the procedure the elapsed time indicated in the counter 21' is the sum of the aforementioned D and E.

When the hands indicate 5 oclock, the user as stated above operates the external member 10 again whereby a signal is applied to the control circuit 24. The control circuit 24 transmits a signal to the select circuit 20, and the driving pulses normally applied to the motor 4 are stopped. Although the driving pulses are not applied to the motor 4, and the hands stop moving, the oscillator 1 and the divider network 2 continue their output of high frequency and divided down frequency signals respectively, and measurement of actual elapsed time needed for the setting of the alarm continues to be recorded in the counter 21'. The short period of time when no driving pulses are applied and there is no hand movement, is provided to allow the user to check visually whether the alarm time is set correctly on the face of the dial 34. The control circuit 24 is constructed so that the period of time when there is no hand motion is 5 seconds. The hands begin to move again 5 seconds after the hands stop moving. At this time, an evaluation is made by the control circuit 24 to determine which way is the shortest distance for the hands to travel from the alarm setting back toward the first present time position. The control circuit 24 then selects either a forward or a reverse drive for the motor 4. In the example, used for illustrative purposes, because the return of the hands from 5 o'clock to the first present time position, 4:10 oclock, by reversed hand motion requires less time, the control circuit 24 selects reverse motion and instructs the select circuit 20 to transmit driving pulses having a waveform for producing reverse motor operation. The pulses delivered to the motor 4 via the driver circuit 3 are at a rate of 64 Hz. The hands begin travelling in a reverse direction so as to return toward the first present time position by means of driving pulses at a rate of 64 Hz. That is, in one second, the second hand travels, in reverse, over 64 second spacings on the dial, and the hour and minute hands move proportionately as determined by the gear train 5.

However, it is not desired that the hands return to the first present time (4:10) but that they return to the real time which recognizes the time which has elapsed in setting the alarm time on the dial 34. Hereinafter the real or actual time is referred to as the second present time. Therefore, the counter 21 which has been reset to 0 begins to count all the driving pulses used for the required reverse motion starting when the hands begin to reverse. As explained more fully hereinafter, the number of pulses required to return the hands to the second present or real time is shown as C in FIG. 5. Note that the counter 21' continues uninterruptedly to count the pulses representative of actual elapsed time. The five second period when the hands do not move is indicated as F in FIG. 5 and the time elapsing while the hands return rapidly toward the second present or real time is indicated by G in FIG. 5. In the control circuit 24 it is continuously evaluated whether the running sum of the number of pulses counted by the counter 21 (C) and the number of pulses counted by the counter 21' (B) agrees with the number of pulses stored in the memory circuit 22. As stated above, the value A, in pulse count, is stored in the memory 22. When the sum of the counts, C and B, agrees with the count A stored in memory 22, the control circuit 24 instructs the select circuit 20 to terminate the reverse action of the motor 4 and hands 7,8,9. At that moment, the data in the memory circuit 22 is cleared and the data C which has been counted by the counter 21 is stored in memory 22. In the example described above, the return of the hands to the second or real time positions is accomplished after 44.5 seconds of reverse motion. The total time which has elapsed to set the alarm time and return the hands to real time is indicated in FIG. 5 by the letter B which represents the sum of the times D, E, F and G.

At the moment that the hands have returned to the second present or real time, the control circuit 24 commands the select circuit 20 to deliver the normal forward driving pulses of 1 Hz to the motor 4 via the driving circuits 3. Thus in 44.5 seconds of accelerated reverse motion of the hands, the hands again indicate the second present or real time and are advancing in a normal way. Setting of the alarm time in the wristwatch is thus completed.

The memory 22 now contains an indication of the number of driving pulses required from the second present or real time to the desired alarm setting time of 5 o'clock, that is to say C in FIG. 5. Expressed mathematically, C equals A−B. Beginning at the moment when normal forward motion of the hands commences, the counter 21 counts, starting from 0, the normal 1 Hz driving pulses from the driving circuit 3. When the coincidence detector circuit 23 detects that the number of pulses counted by the counter 21 is equal to the data C stored in the memory 22, a signal is transmitted to the alarm driving circuit 13 which amplifies a signal of 4096 Hz from the divider network 2. The amplified signal at 4096 Hz is transmitted to the alarm means 12 whereby the alarm means are actuated and the user is alerted that the alarm setting time has been reached.

As stated above, this remarkable invention replaces a mechanical alarm mechanism normally used in analog alarm timepieces with an entirely electronic alarm mechanism. This invention provides an analog alarm timepiece with an alarm setting accuracy within better than a few seconds. Such an accuracy in setting the alarm time is worthy of a quartz crystal timepiece of high accuracy. This is accomplished by using simple electronic circuits.

Additionally, because the hands of the timepiece are used to indicate not only the actual or true time in a normal manner but also are used in setting of the alarm, there is no necessity for providing one or two special alarm hands such as are used in conventional alarm timepieces, for example, alarm hand 33 in FIG. 1. Thus the design of the alarm timepiece is refined. As compared to the conventional alarm timepiece having a mechanical alarm mechanism, the alarm timepiece of this invention having an electronic alarm mechanism, is small and thin, and further is excellent in reliability and durability.

Figure 6:
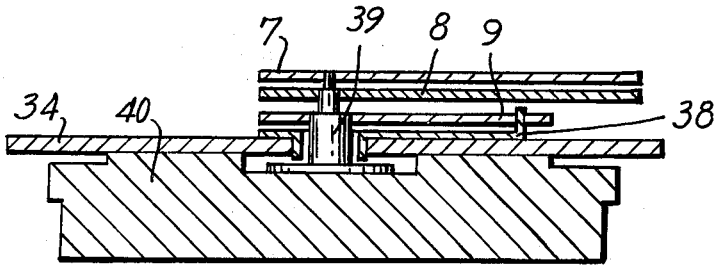
FIGS. 6 and 7 are sectional and plan views respectively of alternative embodiments of the timepiece of this invention.
Figure 7:
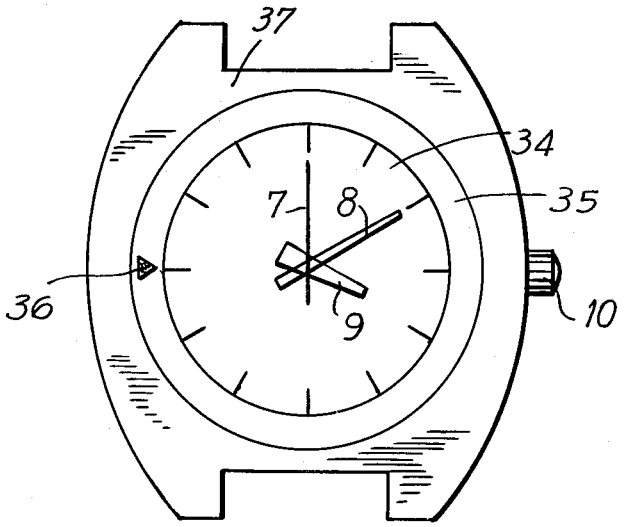

However, because the hands used to indicate the actual or present time are also used as the alarm setting hands in the embodiment described above, it is not possible to simultaneously observe the true time and the time set for the alarm. Alternative embodiments of this invention which compensate for this deficiency are described with reference to FIGS. 6 and 7. FIG. 6 illustrates an analog alarm timepiece including all of the circuitry described in the embodiment above, and also including a split-alarm hand 38. This hand 38 will be visible on the dial 34 of the watch in a manner similar to that illustrated by the alarm hand 33 in FIG. 1. The split-alarm hand 38 is lightly engaged with the dial 34 by friction, and a vertically extending tip 44 of the split-alarm hand 38 engages the hour hand 9. Accordingly, when the alarm time is set in the manner as described above, the split-alarm hand 38 moves with the hour hand 9 by being pushed at the tip 44 by the hour hand. Thus the split-alarm hand 38 is moved to indicate the same alarm time which the hour hand 9 indicates. When the hour hand reverses, as described above, the split-alarm hand 38 retains its position due to the frictional engagement with the dial 34 as the hour hand 9 moves away. Only the hour, minute and second hands return to the second present or real time and the split-alarm hand 38 remains to indicate the set alarm time until the hour hand arrives at the alarm time position again.

In another alternative embodiment (FIG. 7) of this invention, an alarm timepiece having all the circuits described in the first embodiment above, is provided with a rotary bezel 35 on the periphery of the dial 34, which bezel can be rotated by an external operation of the user. The rotary bezel 35 has an indication mark 36 thereon, and the indication mark 36 is rotated to indicate the alarm time. Because the rotary bezel 35 is lightly engaged with the case 37 by friction, once the user has set the indication mark 36 of the rotary bezel 35 to the alarm time position indicated by the hour hand, the rotary bezel 35 does not move when the alarm timepiece is worn. The rotary bezel mechanism is utilized independently of the electronic circuitry to set the alarm time. Also, a combination of the split-alarm hand system and the rotary bezel system is utilized to set a plurality of alarm times for visual observation.

Though the hands which are used to indicate present time in the first embodiment described above are also used as alarm hands, these same hands may be used for a third function. These same hands are also used to measure elapsed hours, minutes and seconds for a stop-watch in the known manner. In such a case, the counter 21' counts the time elapsed while the timepiece is used in the stop-watch function and the hands indicate stop-watch time. When the timepiece is no longer used as a stop-watch, the hands return to the second present or actual time by adding the elapsed time to the first present time. The hands then move in the normal manner to indicate present or real time.

The motion of the seconds hand 7 in advancing the distance of one second on the dial 34 is counted and stored as one second when the alarm time is set in the embodiments described above. If such a motion is counted and stored in memory as one minute, it is possible to set the alarm time with less movement of the hands for a shorter duration of time as compared with the embodiments described above.

This invention is not limited to that embodiment where the hands used to indicate the present time are also used as the alarm hands as described above. In an alternative embodiment of this invention, it is possible that the timepiece be provided with an alarm hand other than the hands used to indicate the present time. The difference between the present time and the time indicated by the alarm hand is a changing value which is always stored in memory. The number of pulses required to move the alarm hand from the time indicted by the alarm hand to the alarm time which the user wants to set, is added to the number of pulses required for the memorized above difference in time. The time elapsed to set the alarm time is counted. Then the alarm time setting cycle is completed in the same manner as described in the first embodiment of this invention. This is an alternative embodiment of this invention, and does not depart from the subject matter of this invention.

This invention can be applied to a two-handed timepiece which does not have the second hand but only shows minutes and hours.

In the first embodiment described above, a reversal of the hands from the alarm time setting back to the real or present time is used as an example. It should be understood that either forward or reverse motion can be utilized within the scope of this invention. The number of pulses from the first present time to the alarm set time would be stored in memory. After the five second pause when the hands are stopped for the convenience of the user in observing the time which has been set on the alarm, the hands are again put into forward accelerated motion until the counter indicates the value representative of a full 24-hour period. The elapsed time counter continues through the entire procedure and the accelerated forward motion of the hands continues until the hands are driven by a number of pulses equal to the count in the elapsed time counter. At this point the hands will be at the true or present time. The watch then proceeds in the normal manner keeping time until the count on the elapsed time counter equals the count stored in memory. Then the alarm is actuated.

It will be apparent to those skilled in the art that that many minor variations in logic can be applied in providing an electronic analog alarm wristwatch in which the alarm is set primarily by driving the hands. For example, in a alternative on the first embodiment, after the hands are returned to the real or present time, the elapsed time counter 21' can continue until its count equals the original count from the first present time up to the alarm setting. Then the alarm actuates. This method would also return the hands properly to the actual time, taking into account time which has elapsed in the process of setting the alarm.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of setting a secondary function of an electronic analog wristwatch for timekeeping including a high frequency oscillator, a frequency divider network, hands, a driver operating from said divider network to move said hands and means for providing a secondary function, comprising the steps of:

(a) driving the hands from the first present time at an accelerated rate to any desired time setting representative of said secondary function;

(b) concurrently counting the number of pulses required to drive the hands from said first present time to said desired secondary function setting;

(c) concurrently and continuously counting the time elapsing while said wristwatch is diverted for said secondary function setting from normal timekeeping functions;

(d) driving said hands at an accelerated rate toward said first present time;

(e) driving said hands again at normal rate for normal timekeeping when actual present time is reached by said hands, the time required for said hands to reach said actual present time being a function of the pulse count required to move said hands from said first present time to said secondary function setting, said pulse count being adjusted by said count of elapsing time.

2. The method of claim 1, and further comprising the steps of:

(f) counting the number of pulses required to drive the hands in normal timekeeping from said actual present time to said secondary function setting;

(g) comparing said normal count required to reach said secondary function setting from said actual present time with said accelerated count required to reach said actual present time from said secondary function setting, coincidence of said counts activating said means for providing a secondary function, whereby said secondary function is actuated when the actual time is that of said secondary function setting.

3. The method of claim 2, wherein an external member of said wristwatch is actuated by the user to initiate concurrently steps (a), (b) and (c); and another actuation of said external member is used to terminate steps (a) and (b) after said hands reach said desired secondary function setting.

4. The method of claim 3, wherein step (a) includes the sub-steps of:

(1) driving the hands from the first present time at an accelerated rate to an intermediate setting prior to said desired secondary function setting;

(2) indicating said intermediate time setting by actuation of said external member; and (3) automatically driving said hands at a normal rate from said intermediate setting to the desired secondary function setting;

whereby said secondary function setting is accurately set by the user.

5. The method of claim 1, wherein step (e) is initiated automatically by said means for providing a secondary function.

6. The method of claim 1, wherein prior to step (d) all motion of the hands is automatically terminated for a fixed period of time whereby the user of said wristwatch may precisely observe the secondary function setting.

7. The method of claim 1 or claim 6, wherein the count of step (b) is stored in a memory device, and step (e) is initiated automatically at actual present time by the further step of counting the pulses required in step (d), adding the count of step (d) to the count accumulated in step (c), and comparing the sum of said counts with the count stored in said memory device, the coincidence of said summed counts and said stored count initiating step (e).

8. A method of setting a secondary function of an electronic analog wristwatch for timekeeping including a high frequency oscillator, a frequency divider network, hands for indicating time, a driver operating from said divider network to move said hands, means for providing a secondary function, and an external member, comprising the steps of:

(a) driving said hands with driver output pulses from the first present time at an accelerated rate toward any desired setting representative of said secondary function;

(b) concurrently counting the number of pulses required to drive said hands from said first present time to said desired secondary function setting;

(c) concurrently and continuously counting the time elapsing while said wristwatch is diverted for said secondary function setting from normal timekeeping functions;

(d) actuating said external member to terminate step (a) at an intermediate hand setting prior to said desired secondary function setting;

(e) driving said hands at the normal rate to said desired secondary function setting;

(f) actuating said external member to terminate step (e);

(g) terminating all motion of said hands for a fixed period of time, whereby the user of said wristwatch may observe the secondary function setting precisely;

(h) storing the count of step (b) in a memory device;

(i) driving said hands at an accelerated rate toward said first present time;

(j) counting the driving pulses required for step (i);

(k) countinuously summing together the counts of step (j) and step (c);

(l) comparing the summed count of step (k) with the count stored in said memory device in step (h);

(m) driving said hands again at normal rate for normal timekeeping when actual present time is reached by said hands, said actual present time being indicated by the coincidence of said compared counts of step (l).

9. The method of claim 8, and further comprising steps for actuating said secondary function as follows:

(n) counting the number of driven pulses required to drive the hands in normal timekeeping from said actual present time to said secondary function setting;

(o) comparing said normal count of step (n) required to reach said secondary function setting from said actual present time with said count required to reach said actual present time from said secondary function setting, coincidence of said counts activating said means for providing a secondary function, whereby said secondary function is actuated when the actual time is that of said secondary function setting.

10. A method of setting a secondary function in an electronic analog wristwatch for timekeeping including a high frequency oscillator, a frequency divider network, hands for indicating time, a driver operating from said driver network output to move said hands, circuits for monitoring hand positions, and means for providing a secondary function, comprising the steps of:

(a) advancing said hands from a first present time to any desired setting time representative of said secondary function;

(b) returning said hands to the actual present time, said actual present time being the first present time plus the time elapsed in advancing and returning said hands, whereby said circuit means actuate said secondary function when said secondary function setting time occurs.

11. The method of claim 9, wherein said advancement and return of said hands is performed at an accelerated rate.

12. The method of claim 8 or 9, wherein all steps subsequent to step (f) are performed automatically by said means for providing a secondary signal.

13. An electronic analog wristwatch including:

a high frequency oscillator;

a divider network dividing down the output frequency signal of said oscillator and providing a low frequency signal output for timekeeping;

means for providing an analog indicator of time on said wristwatch;

means for driving said analog means in response to output signals from said divider network, the rate of driving of said hands being proportionate to the frequency of the output signal from said divider;

means for selectively displacing said analog means to a time representative of occurrence of said secondary function and from said secondary function setting to the then present time without interrupting the operation of said divider network;

secondary function means;

means for storing said secondary function setting at least in part in response to the displacement of said analog means;

and means for activating said secondary function means in response to the substantial coincidence of secondary function time as recorded in said storing means and present time.

14. The electronic analog wristwatch of claim 13, wherein said storage means stores a count representative of the displacement of said analog means to said secondary function setting less the time elapsed between commencement of secondary function setting and resumption of normal timekeeping.

15. The electronic analog wristwatch of claim 14, wherein said divider network includes means for providing an intermediate frequency output signal of a frequency higher than said timekeeping output frequency, and including selection means for selectively applying said intermediate frequency signal to said driving means for driving said analog means at an accelerated rate during at least a portion of the displacement of said analog means to said secondary function time during secondary function setting.

16. The electronic analog wristwatch of claim 15, wherein said selection means is adapted to apply said intermediate frequency signal to said driving means to advance said analog means at an accelerated rate during at least a portion of the displacement of said analog means from said secondary function setting to said then present time.

17. The electronic analog wristwatch of claim 15, including manually actuatable switch means coupled at least to said selection means, said selection means being adapted to apply said intermediate frequency output signal to said driving means in response to a first actuation of said switch means to displace said analog means to a position in advance of said secondary function setting, and to apply said timekeeping output signal to said driving means in response to a second actuation of said switch means for displacing said analog means to said secondary function setting at a normal rate.

18. The electronic analog wristwatch of claim 13 or 17, wherein said analog means are hands.

19. The electronic analog wristwatch of claim 17, wherein said selection means is adapted to apply a signal to said driving means for displacing said analog means when at said secondary function setting to said then present time in response to a third actuation of said switch means.

20. The electronic analog wristwatch of claim 19, wherein said selection means is adapted to stop the displacement of said analog means at said secondary function setting in response to said third actuation of switch means for a predetermined period of time before applying a signal to said driving means for displacing said analog means to said then present time.

21. The electronic analog wristwatch of claim 20, wherein said signal applied by said selection means to said driving means during displacement of said analog means to said then present time is, at least in part, said intermediate frequency signal.

22. The electronic analog wristwatch of claim 14, wherein said storage means includes a first counter means for counting said low frequency signal output for timekeeping; second counter means for counting the input signal to said driving means; memory means; control circuit means for storing the count of said second counter in said memory means in advance of displacement of said analog means to the then present time and resetting said second counter, and a coincidence detector for comparing the count stored in said memory means, the sum of the counts of said first and second counters during displacement of said analog means to the then present time, said control circuit means resetting said memory means with the count of said second counter means at a detection of coincidence by said coincidence detector.

23. The electronic analog wristwatch of claim 1, and further including an alarm time hand for indicating the set alarm time on the face of said wristwatch, said alarm time hand being pushed along by advancement of said timekeeping hands, said alarm time hand remaining in position when the motion of said timekeeping hand is reversed, whereby said alarm hand provides visual indication of the alarm time set by said timekeeping hands.

24. The electronic analog wristwatch of claim 1, and further including a rotating bezel around the face of said wristwatch, said bezel having a marker thereon, said marker rotated by the user of said wristwatch to the alarm time setting when said timekeeping hands are advanced to set said alarm time.

25. The electronic analog wristwatch of claim 18, wherein said secondary function is an alarm, and said secondary function setting is the desired time for actuation of said alarm.

* * * * *